US006231374B1

(12) United States Patent
Kuo

(10) Patent No.: US 6,231,374 B1
(45) Date of Patent: May 15, 2001

(54) CABLE END CONNECTOR

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,733

(22) Filed: Dec. 29, 1999

(51) Int. Cl.[7] ..... H01R 13/58
(52) U.S. Cl. ..... 439/455; 439/610
(58) Field of Search ..... 439/610, 447, 439/604, 606, 465, 467, 455

(56) References Cited

U.S. PATENT DOCUMENTS 4,310,213 * 1/1982 Fetterofl, Sr. et al. ..... 439/455
4,592,612 * 6/1986 Kikuta ..... 439/610
4,641,906 * 2/1987 Olsson ..... 439/610
4,929,195 * 5/1990 Seidoh ..... 439/610
4,990,103 * 2/1991 Sazaki et al. ..... 439/455
5,108,313 * 4/1992 Adams ..... 439/610
5,295,859 * 3/1994 Kawai et al. ..... 439/447
5,609,499 * 3/1997 Tan et al. ..... 439/455
5,797,771 * 8/1998 Garside ..... 439/610

* cited by examiner

*Primary Examiner*—Gary F. Paumen
(74) *Attorney, Agent, or Firm*—Wei Te Chung

(57) ABSTRACT

A cable end connector for connecting with a cable comprises an upper and a lower metal cover. The upper and lower covers together define an opening. The cable comprises an insulative coating, a shielding braid and a plurality of core wires. A strain relief mechanism disposed at the end of the cable comprises a grounding ring and a strain relief. The strain relief includes a stepped portion and a circular body. An annular groove is formed between the circular body and the stepped portion for accommodating the grounding ring. The grounding ring is electrically connected to the cable shielding braid and forms a pair of contacting wings extending outwardly therefrom. The strain relief is integrally formed with the insulative coating. In assembly, the edge of the opening is received in the annular groove and electrically contacts the contacting wings for discharging static electricity accumulated on the cable shielding braid to the covers.

1 Claim, 4 Drawing Sheets

CABLE END CONNECTOR

BACKGROUND OF THE INVENTION

The present invention relates to a cable end connector, and particularly to a cable end connector having a strain relief mechanism.

Taiwan Patent Application Nos. 81,201,975, 83,211,903 and U.S. Pat. No. 4,929,195 each discloses a conventional cable end connector. The conventional cable end connector comprises an upper cover, a lower cover, a circuit board and a stopper. A cable comprises a plurality of core wires which are soldered to the circuit board and received in the cable end connector. The stopper is integrally formed with an insulative coating covering the cable. An annular groove is formed in the surface of the stopper to engage with the covers. When an external force is exerted on the cable, the stopper transmits the force to the covers, thereby preventing the core wires from separating from the corresponding circuit board.

However, during signal transmission, the core wires are subjected to EMI (electromagnetic interference). The conventional cable end connector can not provide a reliable grounding element for discharging static electricity accumulated on the cable. Therefore, signal transmission is adversely effected.

BRIEF SUMMARY OF THE INVENTION

A main object of the present invention is to provide a cable end connector having a strain relief mechanism for providing a reliable connection between a cable and the cable end connector, and preventing signal transmission from being adversely effected by EMI thereby ensuring reliable signal transmission.

To fulfill the above-mentioned object, a cable end connector in accordance with the present invention comprises an upper and a lower metal cover. The upper and lower metal covers jointly define an circular opening. A cable comprises an insulative coating, a shielding braid and a plurality of core wires. These core wires are received in the cable end connector. A strain relief mechanism comprises a grounding ring and a strain relief. The grounding ring includes a ring body and a pair of contacting wings extending from opposite edges thereof. The strain relief includes a stepped portion and a circular body. An annular groove is formed between the circular body and the stepped portion for accommodating the grounding ring. A circular band of insulative coating is removed from the cable to expose a band of circular shielding braid. The grounding ring is riveted and soldered to the shielding braid then electrically conducted between the edge of the openings and the shielding braid. In assembly, the strain relief is integrally formed with the insulative coating. The edge of the opening of the covers is received in the annular groove and electrically contacts the contacting wings for discharging static electricity accumulated on the shielding braid to the covers. Resilient latches extend from the contacting wings for reliably contacting the metal cover.

Other objects, advantages and novel features of the invention will become more apparent from the following detailed description when taken in conjunction with the accompanying drawings.

DETAILED DESCRIPTION OF THE INVENTION

Figure 1:
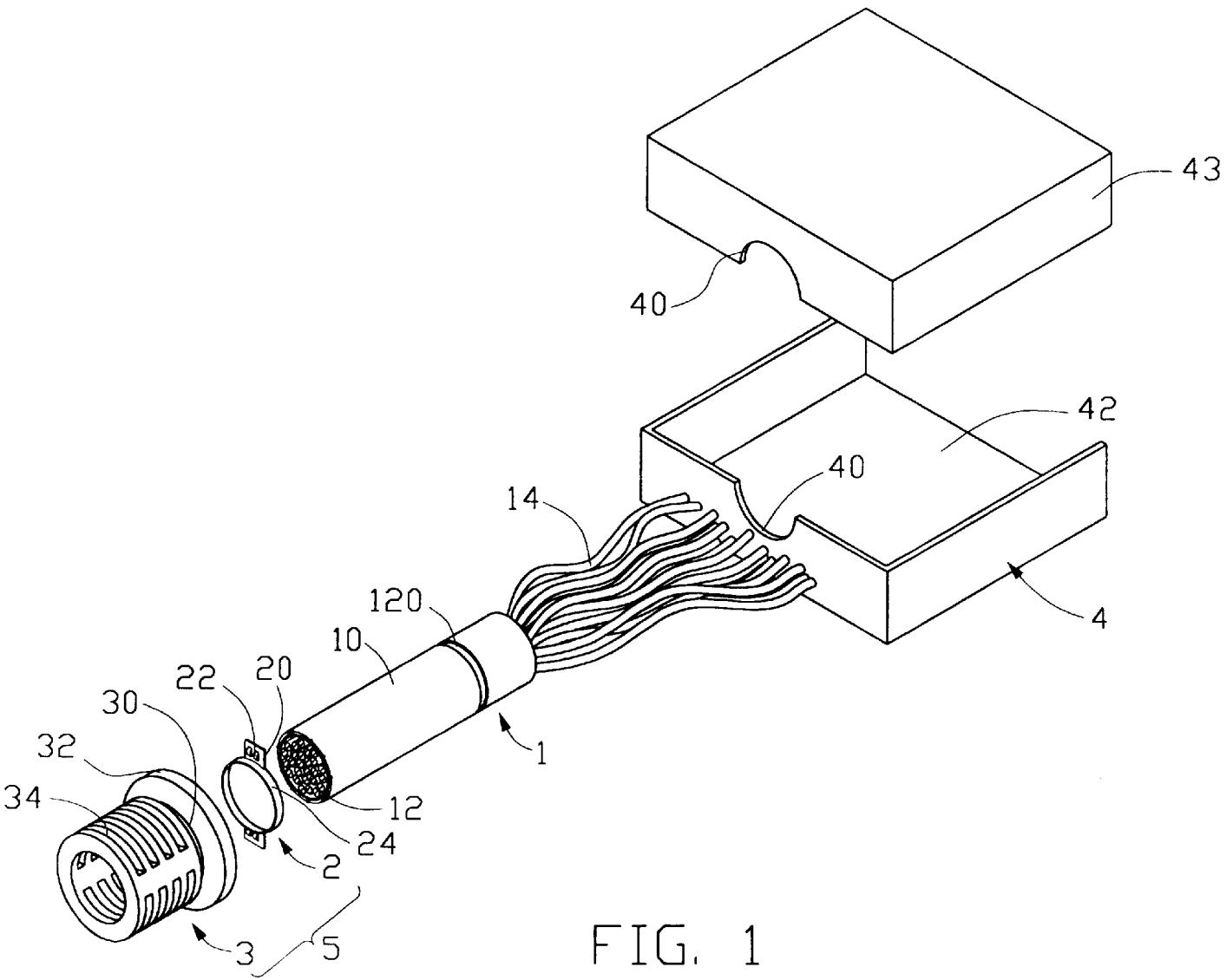
FIG. 1 is an exploded view of a cable end connector and a cable in accordance with the present invention.

Referring to FIG. 1, a cable end connector 4 is used for connecting with a cable 1. The cable end connector 4 comprises a circuit board (not shown) and an upper and a lower metal cover 43, 42. The upper and lower covers 43, 42 are made from metal material and together define an opening 40 for extension of the cable 1. The cable 1 comprises an insulative coating 10, a shielding braid 12 and a plurality of core wires 14. The shielding braid 12 is made from a metal material and shrouding the core wires 14 therein for providing EMI protection. The insulative coating 10 surrounds the shielding braid 12. These core wires 14 are soldered to the circuit board received in the cable end connector 4.

A strain relief mechanism 5 is attached to the cable 1 and comprises a grounding ring 2 and a strain relief 3. The grounding ring 2 includes a ring body 24 and a pair of contacting wings 20 extending from opposite edges thereof. A pair of resilient latches 22 is formed on each contacting wing 20. A circular band is removed from the insulative coating 10 to expose a band of circular shielding braid 120 and the grounding ring 2 is riveted and soldered on the circular band of shielding braid 120. The strain relief 3 includes a stepped portion 32 and a circular body 34. An annular groove 30 is formed between the circular body 34 and the stepped portion 32 for accommodating the grounding ring 2.

Figure 2:
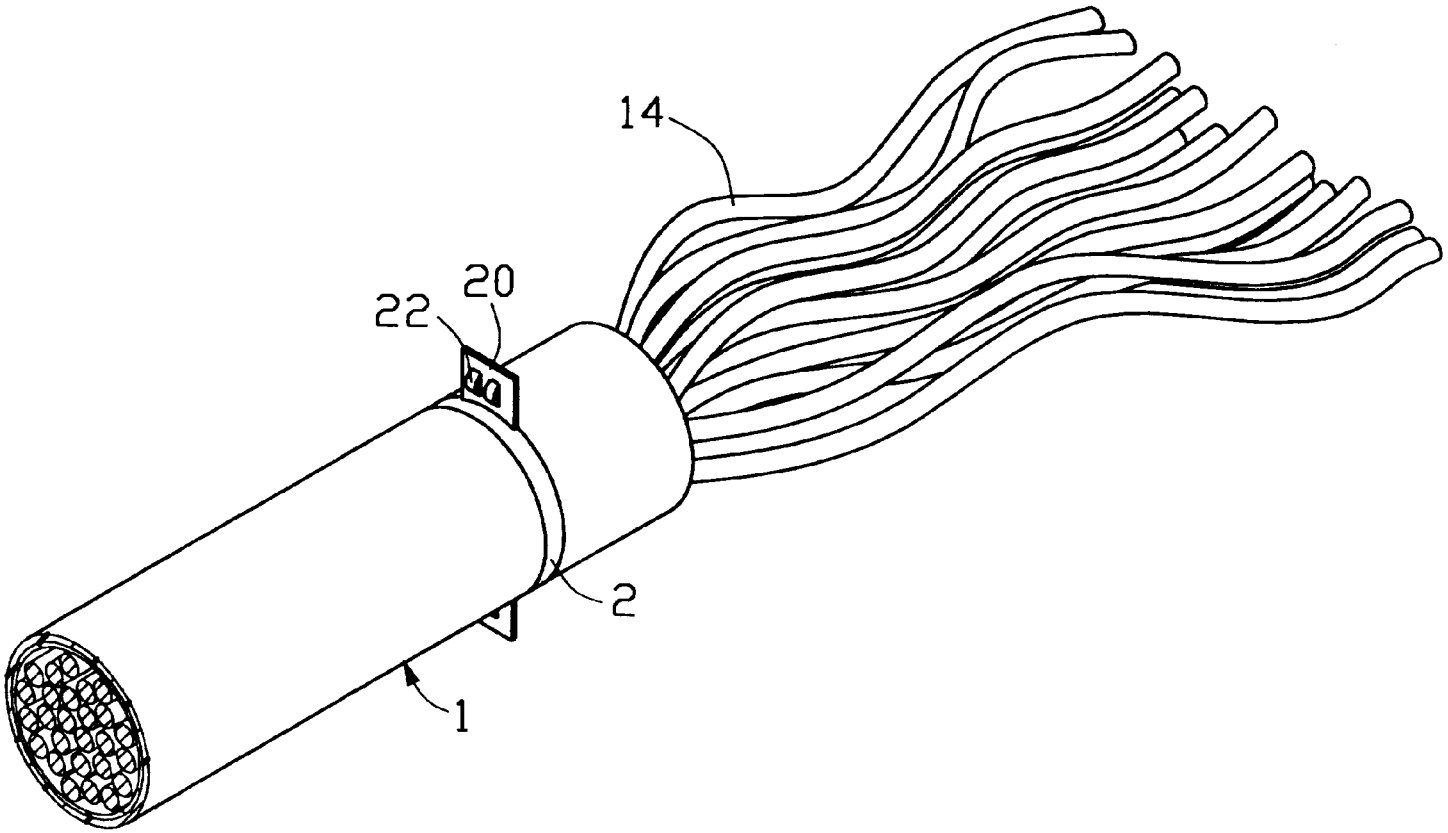
FIG. 2 is a perspective view of a grounding ring assembled with the cable.
Figure 3:
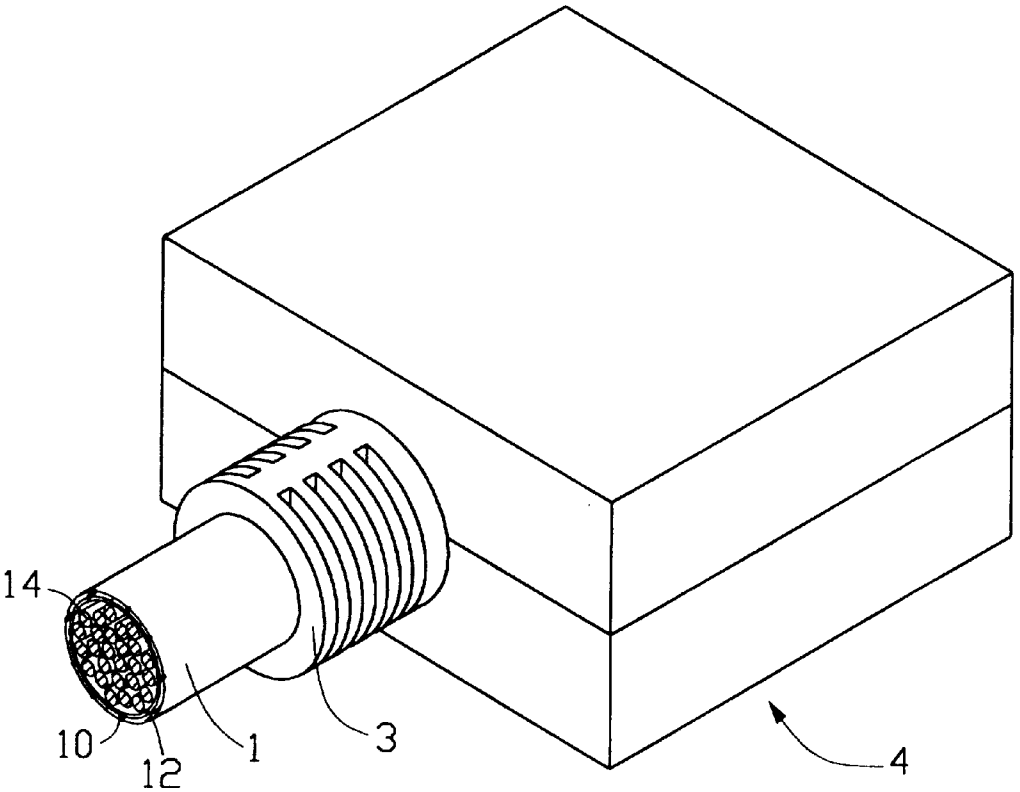
FIG. 3 is an assembled view of FIG. 1.
Figure 4:
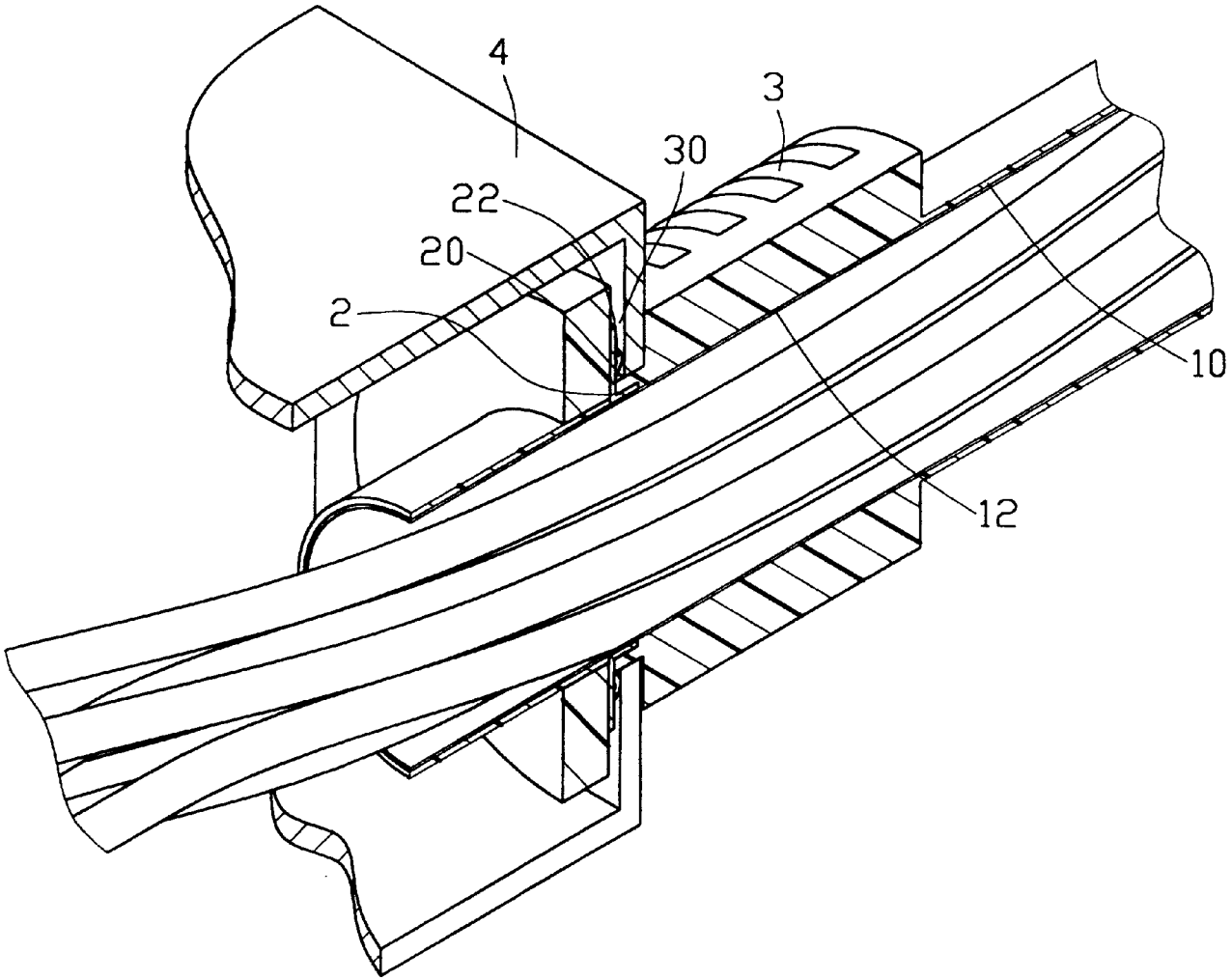
FIG. 4 is a partial, enlarged, cross-sectional view of the cable assembled to the cable end connector.

Referring to FIGS. 2 to 4, the grounding ring 2 electrically engages with the exposed band of circular shielding braid 120 and is retained in the annular groove 30 of the strain relief 3. Therefore the contacting wings 20 establish an electrical path between the edge of the openings 40 and the shielding braid 12. The resilient latches 22 extend from the contacting wings 20 for reliably contacting the upper and lower metal cover 42, 43. The strain relief 3 is integrally formed with the insulative coating 10 and the stepped portion 32 is received in the assembled covers 42, 43. The edge of the opening 40 is received in the annular groove 30 and electrically contacts the contacting wings 20 for discharging static electricity accumulated on the shielding braid 10. In this way, static electricity can be reliably discharged and EMI can also be effectively eliminated. Thus reliable signal transmission is ensured.

The core wires 14 received in the cable end connector 4 are arranged in an orderly fashion for soldering to a corresponding circuit board. When an external force is exerted on the cable 1, the external force can be transmitted via the stepped portion 32 of the strain relief 3 to the cable end connector 4. Therefore, the connection between the core wires 14 and the circuit board is reliably protected.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable including a plurality of core wires encapsulated by a metal shielding braid, and an insulative coating enclosing said shielding braiding, a section of said insulative being removed thereby exposing a section of said shielding braid, said cable having at least an end section not enclosed by said shielding braid;

a cable end connector coupled to said end section of said cable and having upper and lower metal covers defining an opening for extending of the cable; and a strain relief mechanism fixedly and electrically attaching said cable to said covers, comprising:

a grounding ring being soldered on the exposed section of the shielding braid and arranged in the opening, the grounding ring including a ring body and a pair of contacting wings diametrically extending outwardly from opposite edges of the ring body; and a strain relief integrally formed with the insulated coating of said cable, the strain relief having an annular groove for exposing the pair of contacting wings of the grounding ring;

wherein the strain relief has a circular body and a stepped portion together defining the annular groove therebetween;

wherein the contacting wings electrically contact the metal covers;

wherein a pair of resilient latches is formed in each contact wing.

* * * * *